United States Patent [19]

Hyland

[11] Patent Number: 5,009,578

[45] Date of Patent: Apr. 23, 1991

[54] MOTOR DRIVEN PUMPS

[75] Inventor: George J. Hyland, Norristown, Pa.

[73] Assignee: Crane Co., New York, N.Y.

[21] Appl. No.: 114,403

[22] Filed: Oct. 27, 1987

[51] Int. Cl.[5] ..... F04B 35/04

[52] U.S. Cl. ..... 417/365; 417/370

[58] Field of Search ..... 417/366, 369, 370, 372, 417/DIG. 1, 357, 365; 415/170 A, 172 R, 213 B; 416/186 R

[56] References Cited

U.S. PATENT DOCUMENTS

| | | | |
|---|---|---|---|
| Re. 26,438 | 8/1968 | White | 417/357 |
| 2,982,224 | 5/1961 | Williams | 415/172 X |
| 3,220,350 | 11/1965 | White | 417/370 X |
| 3,276,390 | 10/1966 | Bloodoff et al. | 417/DIG. 1 X |
| 3,460,843 | 8/1969 | Jaeger | 415/170 A X |
| 3,510,230 | 5/1970 | Raub | 415/170 A |
| 4,115,038 | 9/1978 | Litzenberg | 417/369 X |
| 4,234,293 | 11/1980 | Lightle | 417/357 X |

FOREIGN PATENT DOCUMENTS

| | | | |
|---|---|---|---|
| 0043389 | 8/1960 | Poland | 417/370 |

*Primary Examiner*—Leonard E. Smith
*Assistant Examiner*—Eugene L. Szczecina, Jr.
*Attorney, Agent, or Firm*—Z. T. Wobensmith, III

[57] ABSTRACT

Motor driven pumps are provided of the canned, or isolated stator type which include a center shaft, rotating shaft support bearings, controlled cooling, and automatic thrust balancing construction, utilizing fixed orifices. A snubber is carried on the shaft at the shaft end opposite to the impeller. The snubber has an en surface which faces an end liner plate. Thrust balancing is achieved by axial movement of the shaft which permits fluid flow between the end liner plate and the snubber.

6 Claims, 2 Drawing Sheets

MOTOR DRIVEN PUMPS

BACKGROUND OF THE INVENTION

1. Field of the Invention

This invention relates to motor driven pumps of the canned or isolated stator type.

2. Description of the Prior Art

Motor driven pumps having motor stators in which the stator electrical windings are isolated from the pumped fluids are called "canned" motor pumps and are well known in the art. Such pumps are utilized where corrosive, toxic and expensive fluids are handled and eliminate rotating seals and stuffing boxes which connect the hydraulic apparatus to a motor, which could leak fluids to the atmosphere and cause hazardous conditions and expensive loss of fluids.

An electric motor requires cooling to properly perform, and most standard motors have built-in fans to provide cooling. A canned motor stator that is hermetically sealed cannot be cooled in this fashion and, therefore, some of the fluid that is being handled is recirculated through the motor between the rotor and canned stator for this purpose. This design is common to the U.S. Patents to White U.S. Pat. No. 2,906,208; and to Litzenberg, U.S. Pat. Nos. 2,871,791 and 4,065,237. These patents utilize internal fluid circulation for cooling purposes, but are subject to various limitations and problems.

Many additional designs have been developed which use external fluid circulation, such as the U.S. Patents to White U.S. Pat. Nos. 2,713,311; 3,053,189; and 3,114,090, which are illustrative of that art.

Canned motor pumps that utilize internal circulation depend upon the clearance between the rotor and stator as an orifice for controlling the amount of fluid flow through the motor section. The following difficulties arise from this method of fluid control:

1. The variances in the manufacturing tolerances which constitute this fluid gap are of such a magnitude that either more or less of the desired flow is obtained;

2. The rotor and stator of a canned motor pump vary in length depending upon the horsepower of the pump and this results in an unstable and unpredictable volume of fluid; and 3. The fluid pressure developed in the volute section is completely variable due to the operating conditions and coupled with 1 and 2 above does not provide an accurate flow for the purposes of cooling the motor.

Fluid flow for the purpose of stator cooling must vary with the horsepower developed by the motor, too much causes a drop in efficiency of the machine and too little will reduce the service life of the pump. For example, intensive tests have established that 3 GPM of room temperature fluids is required to properly cool the stator section in a 3 HP motor. Any more fluid is unnecessary and seriously affects the hydraulic efficiency of the unit and any less may be detrimental to the service life of the motor windings. Tests on hundreds of production units have positively demonstrated, that due to the conditions stated above, the use of the clearance between the rotor and stator sections for fluid flow do not control the fluid flow in a satisfactory manner.

The utilization of an orifice of predetermined size will provide the proper fluid flow control since this orifice should be size for the individual horsepower and motor cooling requirements of any size pumps. This orifice eliminates all of the deviations that arise from the use of the gap between the rotor and stator as a metering medium for cooling or other purposes.

To make this orifice effective it is mounted into a plate that has no other openings of consequence from the pump chamber into the stator and rotor section. The orifice is a control orifice to permit the fluid flow to continue to the hollow shaft which returns recirculated fluid to suction or the impeller.

An additional problem to the cooling problem is thrust balancing.

Since canned motor driven pumps of the type illustrated use the clearance between the rotor and stator as a variable orifice for controlling fluid flow, they are very sensitive to electrical forces which tend to center the rotor, and make thrust balancing difficult, since the volume of fluid going through the orifice between the rotor and isolated stator and through the bearings can seriously affect the thrust balance.

The pressure of the pumped fluid is used to operate and control the axial thrust balance of the rotating parts, both electrical and hydraulic. In a single stage closed impeller of a centrifugal pump, a forward thrust is developed due to the differential pressures developed in the front and rear areas of the impeller. The rear plate of the impeller has the fully developed pressures of generated forces across its entire diameter. The front of the impeller has a large suction action of 0 or negative pressure, and a lower pressure from the outside diameter of the impeller to the suction inlet. This low pressure is caused by a front wearing ring which permits escapement of fluids from the impeller front face into the suction.

The differential of the forces on the rear and front of the impeller are of great magnitude which must be neutralized to prevent forward thrust in all other canned motor pumps with the exception of Litzenberg U.S. Pat. No. 4,065,231. In the prior art, thrust washers are provided to handle the thrust forces, however, thrust washers do not neutralize the pressure differential and merely transfer the load to a thrust bearing against which the washer bears. The thrust washer method of handling thrust is inefficient since the washer's action is similar to that of a brake shoe which wastes energy and establishes wearing parts which are costly to make and replace.

Litzenberg and many of the other available designs also utilize fixed non-rotating bearings, which can wear in an egg shaped pattern, resulting in a short service life and requiring frequent replacement. Such bearings are often difficult to replace and may suffer from other problems.

The motor driven pumps of my invention are not subject to the prior art problems, and provide controlled cooling and automatic thrust balancing.

SUMMARY OF THE INVENTION

This invention relates to motor driven pumps of the canned or isolated stator type, which include a center shaft, rotating shaft support bearings, controlled cooling, and automatic thrust balancing.

The principal object of the invention is to provide isolated stator type motor driven pumps that contain improved thrust balancing and cooling construction.

A further object of the invention is to provide canned or isolated stator type motor driven pumps that are easy to service.

A further object of the invention is to provide canned or isolated stator type motor driven pumps that have improved bearing construction for extended service life.

A further object of the invention is to provide canned or isolated stator type motor driven pumps wherein the thrust balancing feature is automatic.

A further object of the invention is to provide canned or isolated stator type motor driven pumps that are durable and long lasting in operation.

A further object of the invention is to provide canned or isolated stator type motor driven pumps that can be used for a wide variety of applications in a large number of sizes.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now more particulary to the drawings and FIGS. 1 to 4 and 6, one embodiment of motor driven pump 10 in accordance with the invention is therein illustrated.

Figure 1:
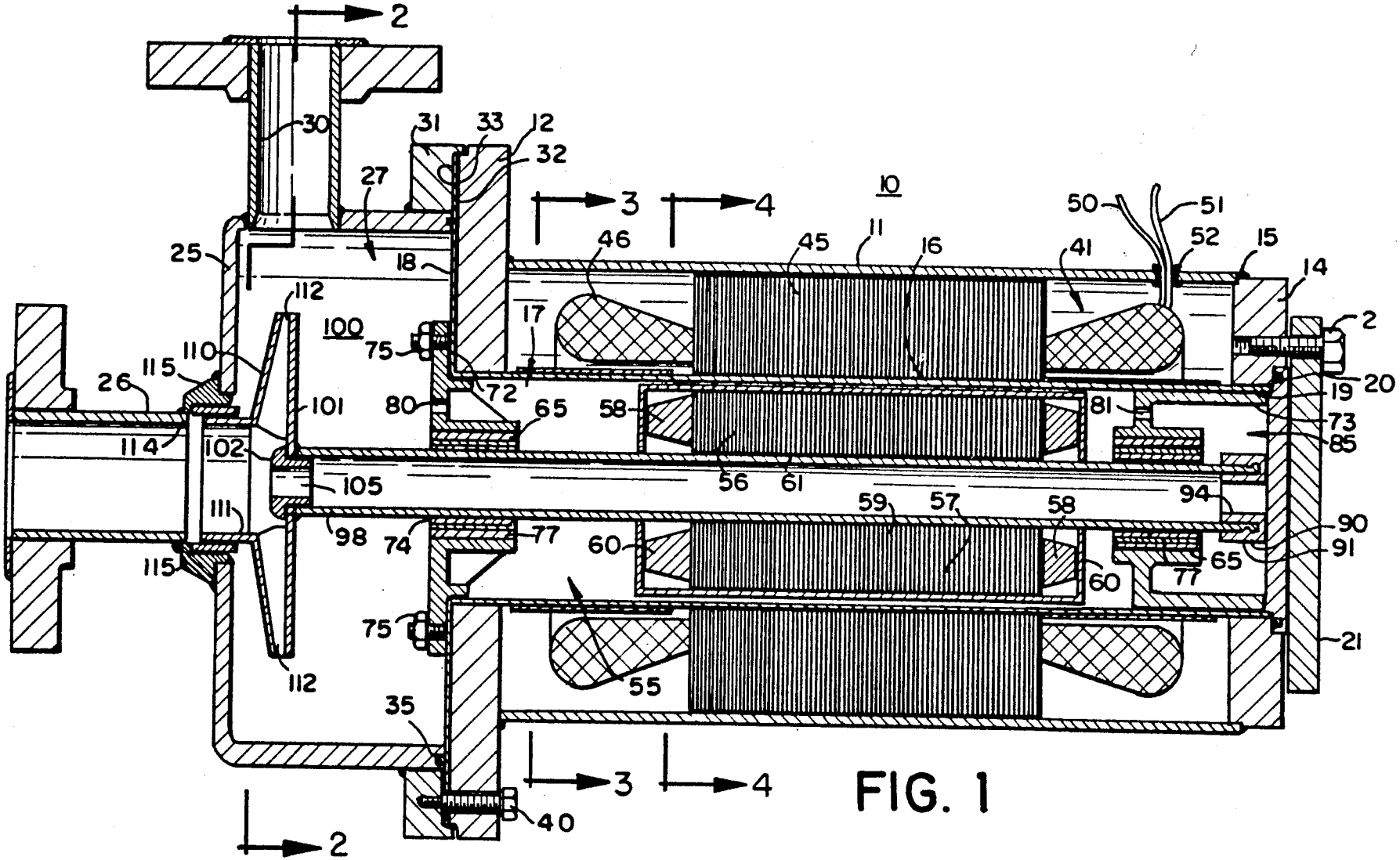
FIG. 1 is a longitudinal sectional view of a preferred embodiment of motor driven pump in accordance with the invention.
Figure 2:
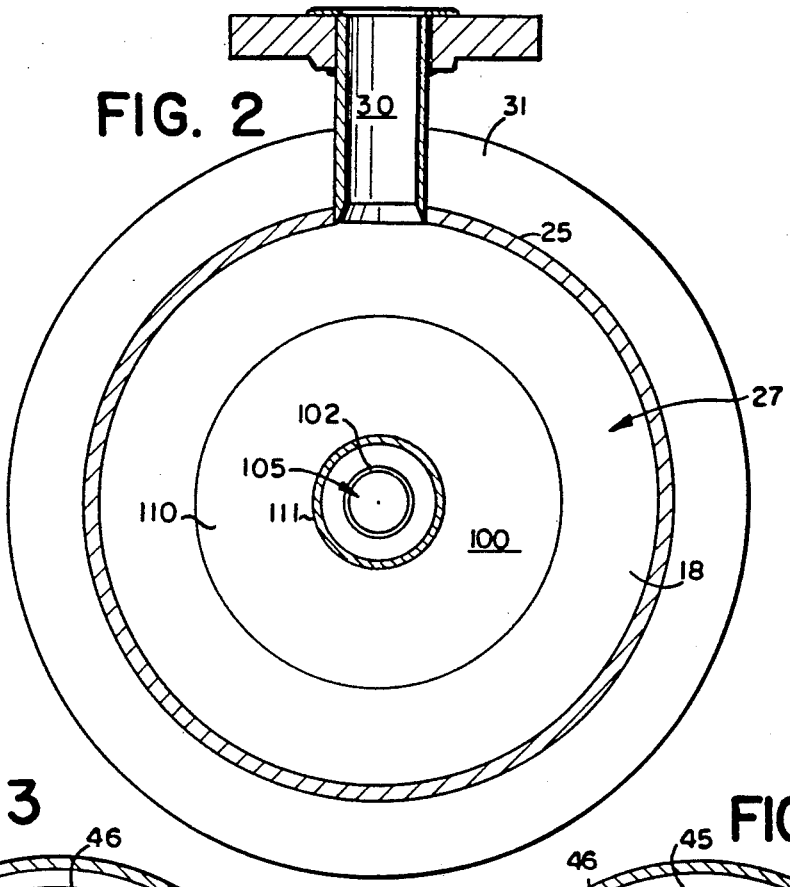
FIG. 2 is a fragmentary sectional view enlarged, taken approximately on the line 2—2 of FIG. 1.
Figure 3:
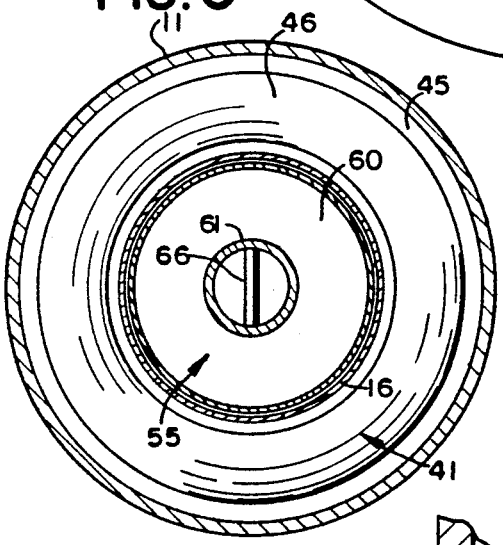
FIG. 3 is a fragmentary sectional view taken approximately on the line 3—3 of FIG. 1.
Figure 4:
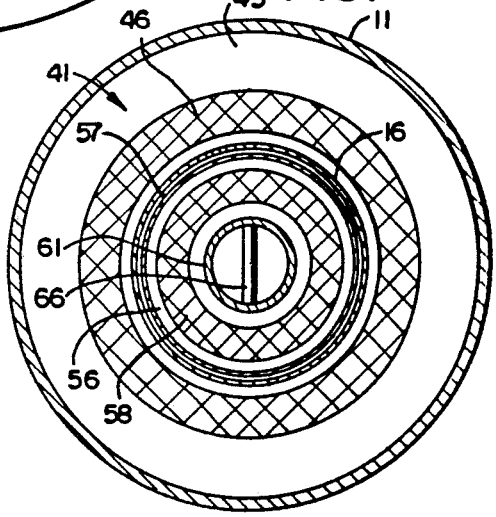
FIG. 4 is a fragmentary sectional view taken approximately on the line 4—4 of FIG. 1.

The pump 10 includes an outer cylindrical casing 11 welded or otherwise secured at the left hand end to an inner end plate 12 as seen in FIG. 1, and having an inner end plate 14 secured thereto at the right hand end by welding or otherwise. The end plate 14 is provided with a shoulder 15, which engages the casing 11 at its end thereof.

A hollow cylindrical inner sleeve 16 is provided, preferably of stainless steel or other non-magnetic responsive metal, and which is not subject to corrosion by the pumped liquids.

The sleeve 16 extends through an opening 17 in the end plate 12, which plate 12 has a liner plate 18 welded or otherwise secured thereto. The liner plate 18 can be of any desired material, such as stainless steel or other suitable material, which is resistant to, or not subject to corrosion by the liquids being pumped.

The sleeve 16 also extends through an opening 19 in end plate 14 and is engaged with an end liner plate 20. An end closure plate 21 engages the plate 20 and plate 14.

The end closure plate 21 is secured to inner end plate 14 by bolts 22, and closes off the opening at the outer end of the end plate 14.

An impeller housing 25 is provided, having an axially disposed fluid inlet 26 for connection to an inlet pipe (not shown), an impeller chamber 27 of concentric shape, and a fluid delivery outlet connection 30 from which a pipe (not shown) extends.

The impeller housing 25 can be of any desired material resistant to corrosion by the liquid being pumped, and for this purpose can be made of stainless steel, titanium or the like. The impeller housing 25 has a flange plate 31 with an inner cylindrical face 32 adapted to engage with an outer cylindrical face 33 of the end plate 12. An O-ring, or other sealing means 35 of rubber, natural or synthetic, or other like compressible or resilient material and resistant to the liquids being pumped, is interposed between the liner plate 18 and the inner face 32 of the flange plate 31, and is compressed in fluid tight condition by bolts or studs 40, which extend through the end plate 12 in threaded engagement in the flange plate 31.

The space between the casing 11, the sleeve 16, the inner end plate 12, and the inner end plate 14 provides a sealed and isolated motor stator chamber 41. The chamber 41, as illustrated, has motor field laminations 45 and motor field windings 46 therein of well known type, which are sealed from contact with the liquid being pumped.

Conductors 50 and 51 for energizing the windings 46 are provided, which extend through a fluid tight seal 52, and are connected to any suitable source of electrical power (not shown).

The space within the interior of the sleeve 16 provides a motor rotor chamber 55.

A motor rotor 56 is provided in the chamber 55, and while it may be of any desired type, is preferably of the induction type with end rings 58 and laminations 59, and with a hollow can or cover 57 to protect them.

The cover 57 has end cover plates 60 secured thereto in well known fluid tight manner, and which engages a hollow center shaft 61, to which they are also secured in well known fluid tight manner. The can/cover 57 and plate 60 are constructed of any suitable material, which is resistant to the temperatures and corrosive action of the liquids being pumped, and may be of stainless steel.

The shaft 61 extends outwardly beyond the rotor end cover plate 60 and has sleeve bearings 65 detachably mounted thereon by friction fit. The bearings 65 are preferably constructed of any suitable lightweight metal, which is resistant to the temperatures and corrosive action of the liquids being pumped. The bearings 65, as shown in more detail in FIG. 6, can include an alloy sleeve 70 with a wear resistant layer 71 of teflon or other suitable material thereon, which layer is sacrificial to the extent necessary.

The bearings 65 rotate in adaptors 72 and 73 at each end, adaptor 72 being fastened to end plate 12 by bolts 75 and adaptor 73 being secured to end closure plate 20 by any suitable means, such as welding.

The adaptor 72 is provided with a shoulder 74 which engages the end of bearing 65. The adaptors 72 and 73 each also include a sleeve 77 which engages the wear layers 71 of bearings 65. The sleeves 77 are formed of any suitable hardened material which is temperature and corrosion resistant to the liquids being pumped, has a smooth surface finish and is compatible with the wear layers 71.

The adaptor 72 is provided with at least one fixed venturi or orifice 80 for fluid communication between the impeller chamber 27 and the motor rotor chamber 55.

The fixed orifice 80 is designed with two purposes, to provide a conduit for fluid flow for both cooling and thrust balancing. Accordingly, the size of the orifice 80 must be determined for each size of pump and can be selected by any person skilled in the art to meet the cooling and thrust balancing requirements for the size and capacity of the pump.

The adaptor 73 is provided with at least one fixed venturi or orifice 81 of larger diameter than orifice 80, for fluid communication between the motor rotor chamber 55, and a chamber 85 which is inside the adaptor 73 and between it and the end liner plate 20.

The shaft 61 in the chamber 85 is provided with a snubber 90, which extends towards the plate 20, has an outer circumferential surface 91, end surface 92, and an inner circumferential surface 94.

The end liner plate 20 has a surface 96 facing the snubber 90 to provide a variable orifice and thrust balancing flow action from fluid flow therebetween, and to permit return of fluid for cooling to be described.

The shaft 61 opposite to plate 20 has an end portion 98 extending into the impeller chamber 27, and is engaged with an impeller 100. The impeller 100 is of conventional type with a side plate 101, and is held in position on shaft 61 by a suitable locking device 102, in threaded engagement in the end of shaft 61. The device 102 has a central opening 105 for fluid flow which is also shaped to receive a wrench (not shown) for tightening the locking device 102 or loosening the same for removal.

The impeller plate 101 has disposed substantially parallel thereto another impeller plate 110, the inner cylindrical portion 111 of which extends toward the inlet 26 for directing the entering fluid between the plates 101 and 110.

The plates 101 and 110 have a plurality of curved vanes 112 extending therebetween, which direct the pumped liquid outwardly for discharge through the outlet connection 30.

A flow limiting construction is provided which includes outer cylindrical portion 114 which extends from plate 110 and is engaged by a sleeve 115 carried in the inlet 26, and may be formed of any suitable material such as teflon.

Figure 5:
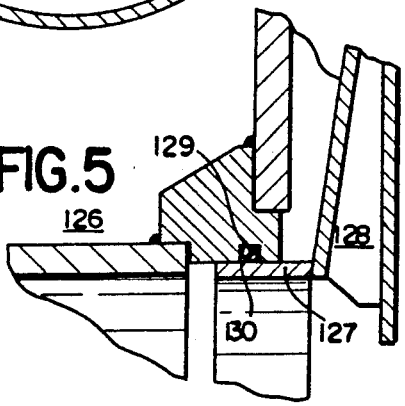
FIG. 5 is a fragmentary view of a portion of the pump as illustrated in FIG. 1 showing an alternate form of impeller bearing construction.
Figure 6:
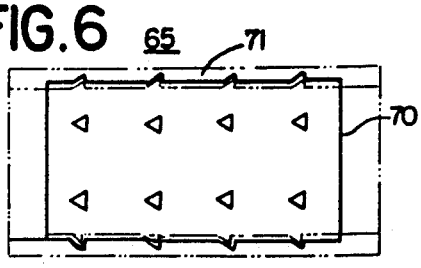
FIG. 6 is a longitudinal sectional view of a preferred embodiment of rotating shaft support bearing.

Referring now more particularly to FIG. 5, an alternate form of impeller flow limiting construction is illustrated, which includes a fluid inlet 126, a cylindrical impeller portion 127 similar to portion 114 and an impeller 128 similar to impeller 100.

The fluid inlet 126 is provided with a circumferential groove 129 which carries an O-ring 130 of conventional type to limit flow and which is in contact with the cylindrical impeller portion 127 to provide a flow limitor.

The mode of operation will now be pointed out.

Upon energization of the windings 46, a rotating field is set up in the laminations 45, which is effective on the rotor 56 to rotate the shaft 61.

Fluid to be pumped is supplied through the pipe (not shown) to the fluid inlet 26, and enters the space within the impeller portion 111 and between the impeller plates 101 and 110. The fluid is guided by the exterior of the locking device 102, and the interior of the impeller plates 101 and 110.

The main body of the fluid being pumped is impelled outwardly by the vanes 112, and is directed by the interior of the chamber 27 to the delivery outlet connection 30.

A portion of the fluid flows through the fixed venturi or orifice 80, into the chamber 55 for cooling, and then flows in the clearance between the cover 57 and the sleeve 16, and through orifice 81 in adaptor 73 into chamber 85. The fluid from chamber 85 flows between surface 96 of end liner plate 20 and surface 92 of snubber 90, then through the interior of the shaft 61, and through the opening 105 of device 102 to the impeller 100 for discharge between vanes 112.

Since the motor rotor 56 is sensitive to electrical forces, and is subject to axial thrust displacement reaction to fluid flow, the shaft 61 moves axially towards an equilibrium position and permits more or less fluid to flow between the surfaces 92 and 96, so that more or less fluid is delivered through the interior of shaft 61 and to the pressure limitor.

The fluid pressure in chamber 85 is therefore varied with the result that the axial thrust forces will tend to balance out and the shaft 61 will tend to slowly move to an equilibrium position.

It should be noted that bearings 65 can be easily removed for replacement by removing end closure plate 21, snubber 90 and adaptor 73. Bearing 65 adjacent to impeller 100 can also be easily removed for service as required. Since the bearings 65 are not subject to thrust, but only axial forces, their service life is greatly extended over bearings used in the prior art, the service life being expected to be approximately four times the conventional service life.

It will thus be seen that structure has been provided with which the objects of the invention are achieved.

I claim:

1. A motor driven pump which includes an impeller housing having inlet and delivery connections and having an impeller chamber witn an impeller therein, an outer cylindrical casing connected to said impeller housing and closed off by first and second end plates, a cylindrical sleeve extending between said end plates and providing therewith and with said outer casing an isolated motor stator chamber, a motor stator in said stator chamber, the interior of said sleeve providing a motor rotor chamber, the improvement which comprises first and second adaptors fixedly mounted within said sleeve at opposite ends thereof, said first adaptor being mounted adjacent said impeller and said second adaptor being mounted at the end opposite thereto, said first adaptor having at least one fixed orifice of selected size therealong connecting the interior of said sleeve with said impeller chamber permitting controlled fluid flow therebetween, an end liner plate between said second adaptor and said second end plate, said second adaptor having at least one fixed orifice therealong of larger diameter than said first orifice and connecting the interior of said sleeve with a chamber formed between said second adaptor and the end plate at the end of said sleeve opposite said impeller for controlled fluid flow therebetween, a hollow shaft having sleeve bearings secured thereto, carried in said first and second adaptors, and extending into said impeller chamber, said impeller being mounted to said shaft in said impeller chamber, a motor rotor on said shaft between said bearings in said motor rotor chamber, said first and second adaptors have sleeves therein engaged with said bearings carried by said shaft, automatic thrust balancing means for balancing the axial forces on said shaft which includes an impeller flow limitor to limit fluid flow from said impeller chamber into said hollow shaft adjacent said end of said impeller, such that axial movement permits fluid flow therein to balance the shaft axial forces, snubber means carried on said shaft in said chamber at the shaft end opposite to said impeller, said snubber means having an end surface, said end liner plate adjacent said snubber means having a surface facing said snubber means end surface, such that axial movement of said shaft permits fluid flow between said end liner plate and said snubber and through said orifice in said second adaptor into said second adaptor chamber in controlled modulated amounts and therefrom into said shaft upon axial movement of said shaft for thrust balancing.

2. A motor driven pump as defined in claim 1 in which said sleeve bearings are comprised of a hollow sleeve with a layer of wear resistant material thereon.

3. A motor driven pump as defined in claim 1 in which said impeller has an outer cylindrical portion extending into said inlet connection, and an impeller flow limitor is provided carried by said inlet connection in contact with said outer cylindrical portion of said impeller.

4. A motor driven pump as defined in claim 3 in which said impeller flow limitor includes an outer cylindrical portion from said impeller which extends into said inlet connection, and a sleeve carried by said inlet connection in contact with said outer cylindrical portion of said impeller, thereby to limit fluid flow therebetween from said impeller chamber into said inlet connection in relation to said shaft axial movement.

5. A motor driven pump as defined in claim 3 in which said impeller flow limitor includes an outer cylindrical portion from said impeller which extends into said inlet connection, and an O-ring carried by said inlet connection in contact with said outer cylindrical portion to limit fluid flow into said inlet connection from said impeller chamber in relation to said shaft axial movement.

6. A motor driven pump as defined in claim 1 in which said snubber means has a flat end surface, said end liner plate opposite said snubber means has a flat surface facing said snubber surface such that axial movement of said shaft permits rapid change of fluid flow between said surfaces into said shaft upon axial movement of said shaft for thrust balancing.

* * * * *

UNITED STATES PATENT AND TRADEMARK OFFICE

CERTIFICATE OF CORRECTION

PATENT NO. : 5,009,578

DATED : April 23, 1991

INVENTOR(S) : GEORGE J. HYLAND

It is certified that error appears in the above-identified patent and that said Letters Patent is hereby corrected as shown below:

Column 1

Line 66, "size" should be - sized - .

Signed and Sealed this

First Day of September, 1992

*Attest:*

DOUGLAS B. COMER

*Attesting Officer*

*Acting Commissioner of Patents and Trademarks*